US007387004B2

(12) United States Patent
Schütz et al.

(10) Patent No.: US 7,387,004 B2
(45) Date of Patent: Jun. 17, 2008

(54) LATCH FOR A MOBILE PART OF A VEHICLE BODY, SUCH AS A FLAP OR A DOOR, ESPECIALLY A REAR OPENING

(75) Inventors: Heiko Schütz, Velbert (DE); Gerd Buschmann, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 170 days.

(21) Appl. No.: 10/522,942

(22) PCT Filed: Jul. 16, 2003

(86) PCT No.: PCT/EP03/07670

§ 371 (c)(1),
(2), (4) Date: Jan. 28, 2005

(87) PCT Pub. No.: WO2004/013435

PCT Pub. Date: Feb. 12, 2004

(65) Prior Publication Data

US 2006/0162405 A1 Jul. 27, 2006

(30) Foreign Application Priority Data

Jul. 30, 2002 (DE) ..... 102 34 553

(51) Int. Cl.
*E05B 13/10* (2006.01)
*E05B 17/18* (2006.01)

(52) U.S. Cl. ..... 70/215; 70/208; 70/240; 70/455

(58) Field of Classification Search ..... 70/158–160, 70/215–217, 208, 209, 237, 238, 211, 224, 70/240, 455, DIG. 67; 292/DIG. 2, DIG. 42, 292/DIG. 43, DIG. 29
See application file for complete search history.

(56) References Cited

U.S. PATENT DOCUMENTS

| | | | | | |
|---|---|---|---|---|---|
| 3,796,076 | A | * | 3/1974 | Miyabayashi et al. | 70/240 |
| 4,586,355 | A | * | 5/1986 | Lee et al. | 70/455 |
| 4,881,391 | A | * | 11/1989 | Villa et al. | 70/455 |
| 5,904,385 | A | * | 5/1999 | Linder | 292/336.3 |
| 6,098,432 | A | * | 8/2000 | Spies | 70/237 |

FOREIGN PATENT DOCUMENTS

| | | | |
|---|---|---|---|
| DE | 298 04 105 | | 8/1999 |
| DE | 100 15 887 | | 1/2002 |
| DE | 100 45 224 | | 3/2002 |
| DE | 10123939 | A1 * | 1/2003 |
| DE | 10123939 | A1 * | 1/2003 |

* cited by examiner

*Primary Examiner*—Jennifer H. Gay
*Assistant Examiner*—Alyson Merlino
(74) *Attorney, Agent, or Firm*—Friedrich Kueffner

(57) ABSTRACT

The invention relates to a latch which must enable the locked mobile part (10) of a motor vehicle body to be released if necessary by means of a key-actuated closing cylinder (40), in order to manually open the mobile part (10). A handle (21) is provided on the mobile part (10) for the opening of the same (10), said handle being able to pivot in a vertical plane in relation to the vehicle body. When the handle is in its closed position (20.1), it is essentially flush with the vehicle body. In the outwardly pivoted open position, the handle can be gripped by a hand, also enabling the closing cylinder (40) to be accessed by the key. In order to provide the latch with a compact design, the handle (21) is embodied as a carrier for the closing cylinder (40) and forms a pivotable arrangement (20) therewith. A rotary coupling member (45) which can be actuated by the closing cylinder (40) is located on said arrangement (20) and participates in the pivoting movement. A rotary coupling counter-member (35) is located on a defined region of the mobile part (10) and acts on the lock. In the closed position (20.1) of the arrangement (20), the rotary coupling member (45) is decoupled from the rotary coupling counter-member (35), but in the open position, is in a coupling position which enables the transfer of torque.

23 Claims, 8 Drawing Sheets

LATCH FOR A MOBILE PART OF A VEHICLE BODY, SUCH AS A FLAP OR A DOOR, ESPECIALLY A REAR OPENING

The invention pertains to a lock assembly for a mobile part of a vehicle body such as a hatch or door, especially for a rear hatch. Here a mobile part is free to move with respect to a stationary part of the vehicle body, this movement normally being of a pivoting type between a closed position and an open position of the mobile part. The closed position of the mobile part is secured by a lock. Such locks are usually operated electrically and/or by remote control. In an emergency, however, such as when the electrical control system fails, the lock can be unlocked mechanically by using a key to actuate a lock cylinder.

These lock assemblies also include a handle on the mobile part, this handle being free to pivot in a plane perpendicular to the vehicle body. Normally, i.e., when at rest, the handle is in its down position, which is flush with the vehicle body. In this position, the handle protects the lock cylinder. So that the mobile part can be opened manually, the handle is swung out into its open, projecting position. It is thus possible to grip the handle conveniently and to pull the mobile part open. In an emergency situation, the lock cylinder is also accessible to the key when the handle is in its up position.

In the known lock assembly of this type (DE 100 45 224 A1), the lock cylinder is mounted permanently in a housing, which is built into the rear hatch of the vehicle. The opening in the housing is normally closed by a cover, which can be pivoted around an axis parallel to the plane of the cover. In its open position, the cover functions as a handle, which can be used to open the rear hatch. The axis of the stationary lock cylinder is oriented toward the opening in the housing. The output of the stationary lock cylinder is connected permanently to the lock, so that, in an emergency, the lock can be moved by the inserted key between its locking position and its unlocking position. For safety reasons, the lock cylinder must be of considerable length, so that the required number of tumblers can be lined up next to each other in the axial direction. This means that the unit takes up an undesirable amount of space in the area assigned to it in the rear hatch—space which is very limited to begin with.

In a known lock assembly of a different type (DE 199 29 243), the keyhole of the lock cylinder is located behind the cover of the vehicle emblem provided on the mobile part. The key can be provided with access to the lock cylinder simply by pivoting or pushing aside the cover. The emblem does not serve as a handle for opening the mobile part. The lock cylinder rests in the mobile part behind the movable cover.

A lid lock for a trunk lid is known (DE 802 046), which consists of two directly adjacent lock parts, which extend across the joint between the movable trunk lid and the stationary trunk lining. The lock part seated on the lining has a spring-loaded locking bar, which extends across a bottom plate of the adjacent lock part, which is seated on the trunk lid. The actual handle is pivotably supported on the bottom plate and is spring-loaded in the direction toward its down position. Although a lock cylinder moves along with the handle, the insertion opening for the lock cylinder is on the visible side of the handle. As a result, the lock cylinder is accessible to the key both in the down position and also in the projecting position and is therefore always unprotected.

The lock cylinder can therefore easily become dirty and thus unusable. In addition, the lock cylinder serves only to secure the handle in its down position on the bottom plate. No provision is made for an emergency situation. So that the handle can be pivoted into its projecting position, the lock cylinder must be actuated by the key. During this pivoting movement, a profile edge of the handle of the lock part on the lid pushes the locking bar of the adjacent lock part far enough away that it releases the bottom plate.

In a lock assembly according to the not previously published DE 101 23 939 A1, the cover does not serve as a handle by which the mobile part can be swung open, but rather as a rocker to actuate the electrically motorized opening of the mobile part. A lock cylinder is mounted on the rear surface of the cover. When the cover is in its down position, this cylinder points into the interior of the mobile part. The cover is pivotably supported at its center so that it can pivot around a horizontal axis and is held in its covering position by a spring. The cover can be moved from its covering position into three different pivot positions. When the cover, which functions as a rocker, is pivoted around a small angle of 15°, it actuates a microswitch, which electronically opens the lock. In this first pivot position, the rear-side lock cylinder cannot be reached by the key. In an emergency, the cover can be pivoted manually around a larger angle of approximately 45° until a spagnolet, located on the output of the lock cylinder makes contact with a stationary lobe on the mobile part. Now, however, the key can be inserted into the lock cylinder, as a result of which the spagnolet is pivoted away from the lobe, and a mandrel on the lock cylinder comes into alignment with an axially movable pin in the interior of the mobile part. Now the cover can be moved manually into a third pivot position, where the mandrel meets the pin and pushes it axially inward. As a result, an unlocking device inside the vehicle is mechanically actuated.

The invention is based on the task of developing a reliable lock assembly of the type indicated above which is designed to be more compact in the depth direction. This is accomplished according to the invention, to which the following special meaning attaches:

In the invention, the handle and the lock cylinder form a combination, which moves as a unit during the pivoting movement; this combination carries the first element of a rotating coupler. When the combination is in its outwardly-pivoted, projecting position, the lock cylinder, which is on the rear side, is accessible to the key. When the lock cylinder is turned by the key, the first element is turned as well, for which reason it will be referred to in the following as the "rotating coupler element". A second, opposing element of this rotating coupler is mounted at a defined point on the mobile part, and when it is turned, its rotational movement is intended to act on the lock. This second, opposing element will be referred to in the following as the "opposing rotating coupler element".

Normally, in the down position of the combination, the rotating coupler element located on the combination is disconnected from the opposing rotating coupler element, for which reason, aside from the fact that the lock cylinder is inaccessible to the key, no torque can be transmitted between the lock cylinder and the opposing element. Because the opposing rotating coupler element is mounted in the same perpendicular plane in which the rotating coupler element moves during the pivoting movement of the combination, the coupling area of this first element travels into the opposing coupling area of the opposing element during the last phase of the opening movement, for which reason it is now possible for torque to be transmitted by the key-actuated rotation of the lock cylinder. In the projecting position, therefore, the torque being transmitted is able to move the lock from its unlocking position into its locking position and vice versa.

In the invention, therefore, the lock cylinder assumes two different positions in the mobile part of the vehicle body, one being the down or closed position, the other the outwardly-pivoted, projecting position. In the down position, the lock cylinder is advisably parallel to the handle, which means that it extends essentially in the main direction of the vehicle body. The large available height of the handle can be used to accommodate the lock cylinder. Because the lock cylinder extends in the main direction of the handle, it is possible to install a large number of tumblers in the cylinder, which increase the number of possible permutations. The lock cylinder and the key can have a very extensive code, which improves the anti-theft security of the lock assembly according to the invention. In the depth direction of the mobile part, the inventive lock assembly occupies a surprisingly small amount of space, which corresponds only to the cross section of the lock cylinder. Because the lock cylinder is always oriented in the main direction of the handle, it is accessible to the key even at relatively small pivot angles. In the outwardly-pivoted position, the lock cylinder of the combination extends considerably beyond the vehicle body.

Additional measures and advantages of the invention can be found in the subclaims, in the following description, and in the drawings. The drawings illustrate an exemplary embodiment of the invention:

Figure 1:
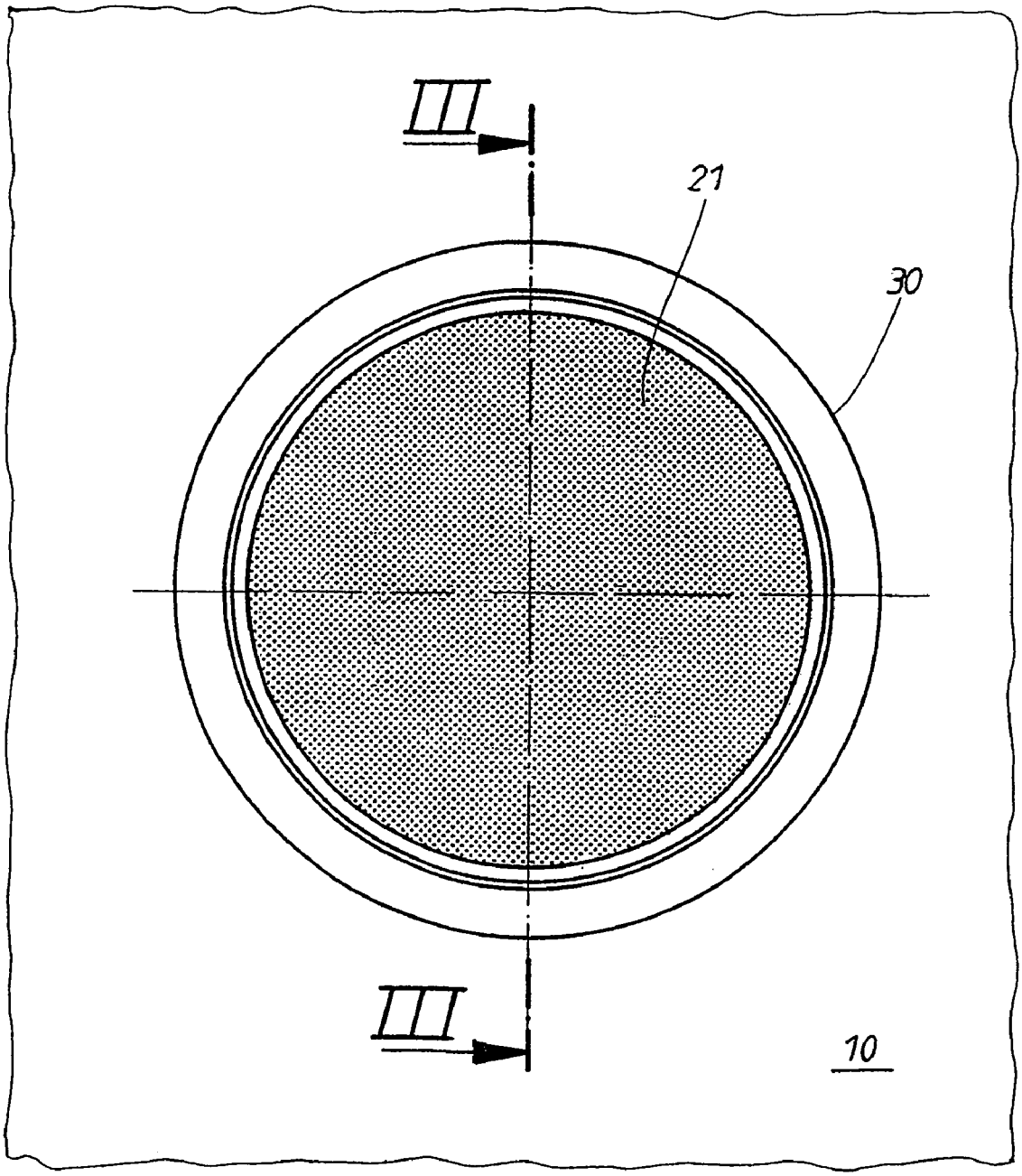
FIG. 1 shows a plan view of part of a vehicle body's rear hatch, which functions as the mobile part, the handle being shown in its down or closed position.
Figure 2:
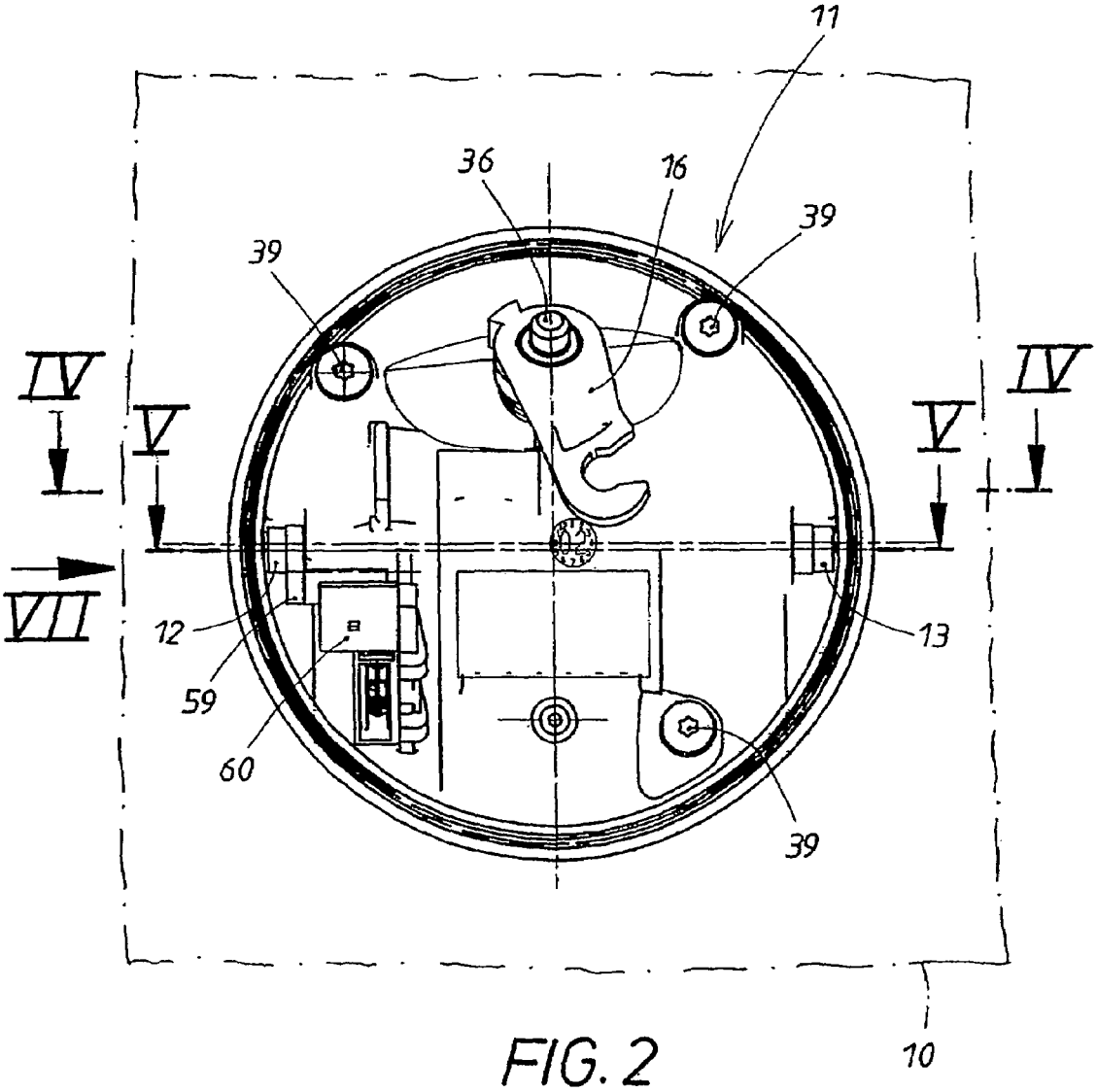
FIG. 2 shows a rear view of the lock assembly of FIG. 1 before it has been installed in the rear hatch, which is indicated in dash-dot line.

The drawings show only a part of a rear hatch 10, serving as a mobile part of the car body. A structural unit 11, consisting of a shell-like housing 30 and a handle 21, which normally closes off the opening 31 of the housing, is mounted in the rear hatch 10. Fastening means 39 for the handle can be seen in FIG. 2. As is especially clear in FIG. 4, the housing 30 is traversed by an axis 15, indicated in dash-dot line, around which the handle 21 is supported in such a way that it can pivot in the housing in the direction of the arrow 25 of FIG. 3. This axis 15 will be referred to below as the "pivot axis". The pivoting movement proceeds in the planes of the drawings of FIGS. 3 and 8. From this it can be seen that the pivoting movement 25 proceeds in a plane which is perpendicular to the main direction of the vehicle body at the location of the structural unit 11, that is, perpendicular to the plane of the rear hatch 10.

Figure 3:
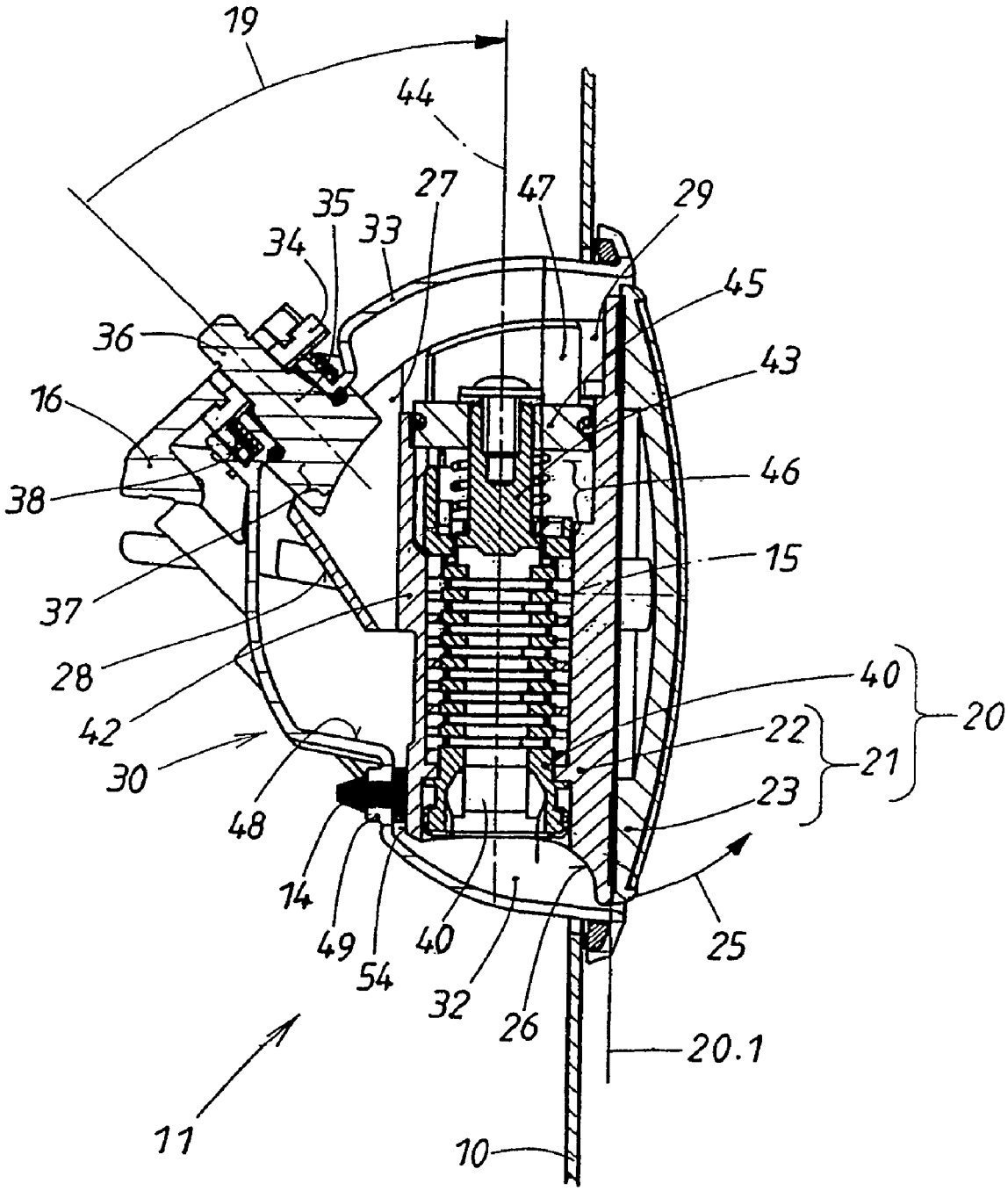
FIG. 3 shows a longitudinal cross section through the lock assembly along the line III-III of FIG. 1.
Figure 4:
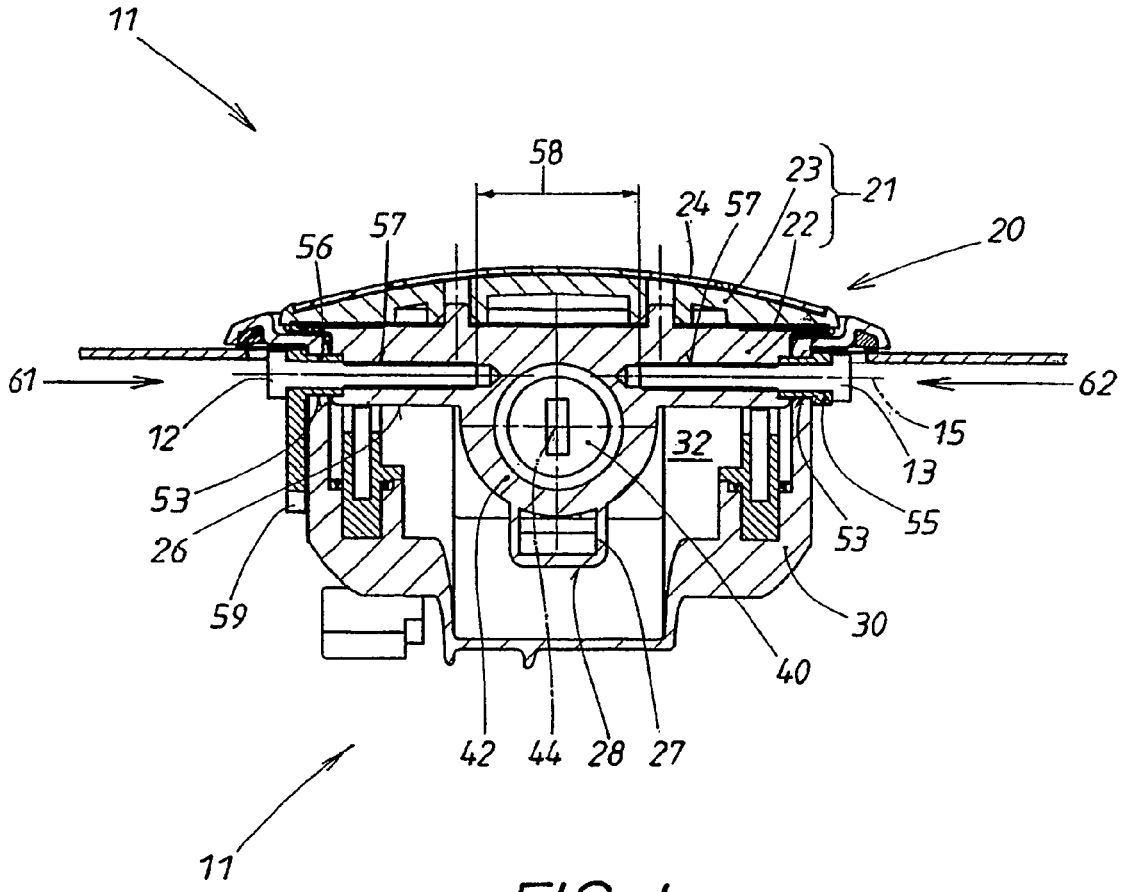
FIGS. 4 and 5 show two cross sections through the lock assembly according to FIG. 2 along the cross-sectional lines IV-IV and V-V shown in that figure.

It can be seen from FIG. 4 that the handle 21 is designed as a two-layer plate; it comprises a base plate 22 and a decorative arched plate 23. The decorative plate 23 carries a company emblem 24. Permanently connected to the handle 21 is a lock cylinder 40, which therefore participates in the pivoting movement 25 of the handle 21. This structural unit 20, consisting of the handle 21 and the lock cylinder 40, is referred to as the "combination", as previously mentioned. The lock cylinder 40 in this case is integrated into the material of the handle 21 and is located on the handle's rear side, characterized by the number 26 in FIG. 4. A cylinder housing 42 holds the lock cylinder 40 and is designed as a single unit with the base plate 22 of the handle 21. The cylinder axis 44, indicated in dash-dot line in FIG. 3, is essentially parallel to the plane of the base plate 22 and lies in the same perpendicular plane as that in which the pivoting movement 25 of the combination 20 takes place. FIGS. 1-7 show the closed position of the combination 20, which is emphasized in FIG. 3 by the auxiliary line 20.1. In this case, the visible side of the combination 20 is essentially flush with the body of the rear hatch 10. The lock cylinder 40 is protected in the interior of the housing.

The output 43 of the lock cylinder is normally connected nonrotatably to a first element 45 of a rotating coupler by way of a freewheel coupling 46, comprising several elements known in and of themselves; the coupling point at the end of the rotating coupler consists of the interior space 47 of a fork. This rotating coupler element 45 is also a component of the combination 20 and accompanies its pivoting movement 25. It will be referred to as the "movable rotating coupler element 45".

Figure 6:
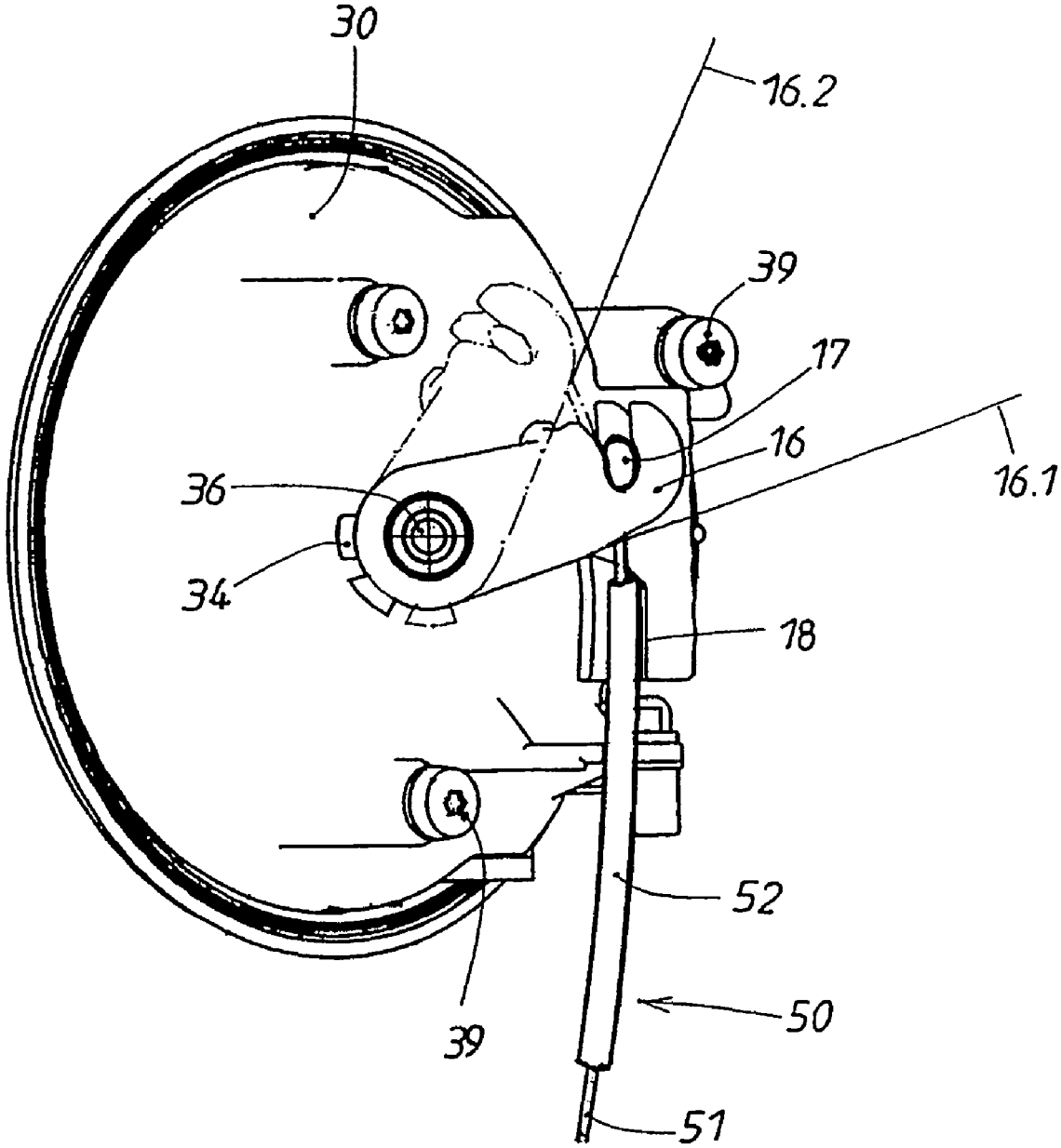
FIG. 6 shows a perspective view, from the rear, of the lock assembly shown in FIG. 2, where the initial part of a Bowden cable is shown, which is a component of a link chain leading to the lock (not shown) of the rear hatch.

In the housing 30, a "stationary opposing rotating coupler element 35" is assigned to this movable rotating coupler element 45; this opposing element has a flat profile piece 37, which serves as its coupling point. When the two parts are coupled together, the flat profile piece 37 fits into the interior space 47 of the fork of the movable rotating coupler element 45. The stationary opposing rotating coupler element 35 is supported rotatably at a defined point in the housing wall 33 by means of a bearing neck 36. On the outside of the housing 30, it is connected nonrotatably by way of an intermediate element 34 and a restoring spring 38 to a driver 16. A link chain 50, which, in the present case consists of a Bowden cable and which leads to the lock in the rear hatch 10, is connected to the driver 16. The core 51 of the Bowden cable, as can be seen at 17 in FIG. 6, is hooked onto a terminal claw on the driver 16. The sheath 52 of the Bowden cable 50 is attached at 18 to the housing 30. When the lock is in its locking position, the driver 16 is in the starting position indicated in solid line in FIG. 6, emphasized here by the auxiliary line 16.1. The previously mentioned restoring spring 38 determines this starting position 16.1. In dash-dot line, FIG. 6 also shows the actuating position, designated by the number 16.2, of the driver 16. When the driver 16 is pivoted into this actuating position 16.2, the core 51 of the Bowden cable is carried along, and the lock of the rear hatch 10 is released. Thus the rear hatch 10 can now be opened, as will be described in greater detail on the basis of FIG. 8.

In the down position 20.1 of the combination 20, the previously described movement of the driver 16 is not possible, because the cylinder axis 44 of the movable rotating coupler element 45 is separated from the axis of rotation of the stationary opposing element 35 by the angle 19 shown in FIG. 3. It is also impossible to rotate the lock cylinder 40, because the handle 21 of the combination 20 makes the interior 32 of the housing inaccessible. This situation changes, however, when the combination is pivoted outward into its open position 20.2 shown in FIG. 8. Now the cylinder axis 44 is aligned with the axis of the stationary opposing element 35, and the movable rotating coupler element 45 is therefore in rotational engagement with the opposing element 35. That is, the flat profile piece 37 of the opposing element 35 is located in the interior space 47 of the movable rotating coupler element 45. When it is in the outwardly-pivoted position 20.2, furthermore, the keyhole of the lock cylinder 40 is readily accessible to the key 41. If the correct key 41 is inserted into the lock cylinder 40, the turning of the key leads to the previously described movement of the driver 16, which acts on the lock. Torque is thus transmitted between the lock cylinder and the driver 16, which leads to the lock. By turning the key 41, the lock can be shifted between its locking position and its unlocking position in an emergency situation.

Figure 8:
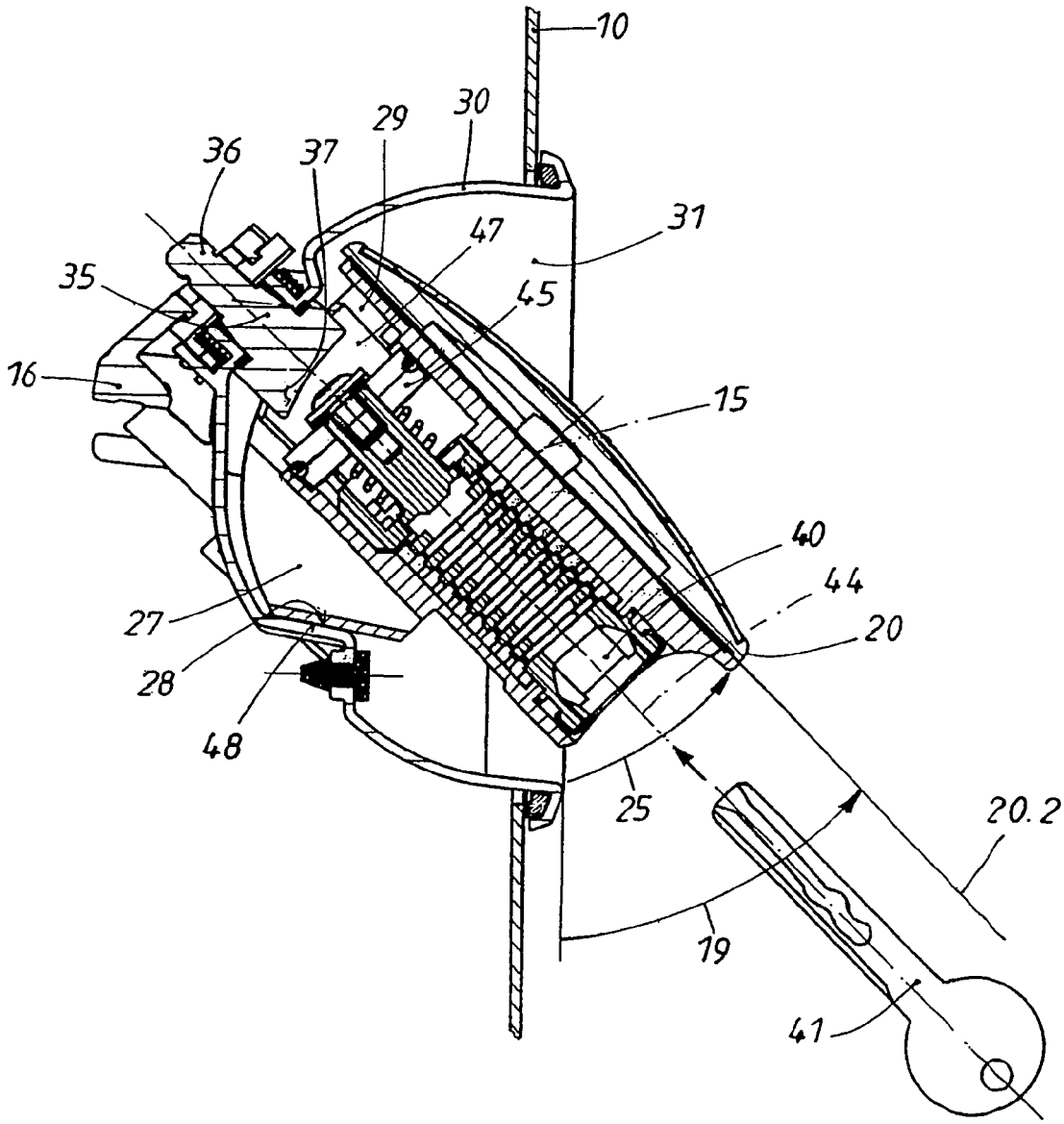
FIG. 8 shows a longitudinal cross section corresponding to FIG. 3 through the lock assembly with the handle in its outwardly-pivoted position, in which the lock cylinder, which moves along with the handle, is accessible to a key.

The outward pivot angle designated by the number 19 in FIG. 8 is determined by a stop 28 on the combination 20 and by a counterstop 48 on the housing 30. These are designed in a special way according to the invention.

Another component of the combination 20, as FIG. 3 shows, is a protective sleeve 27, 29, which is also formed as an integral part of the base plate 22, and which has a special sleeve profile. The sleeve has a narrow section 27, which, in the down position 20.1, accepts the flat profile piece 37 of the stationary opposing rotating coupler element 35. This narrow sleeve section 27 is shown especially clearly in FIG. 5. The dimensions of this narrow sleeve section 27 are selected so that the flat profile piece 37 just fits, with slight clearance. As a result, a double guide action is obtained. The flat profile piece 37 of the opposing element 35 is thus secured in a defined rotational position. In addition, this rotational position of the stationary opposing rotating coupler element 35 is maintained during the pivoting movement 25 until the opposing element's flat profile piece 37 enters the interior space 47 of the fork of the movable rotating coupler element 45. This rotating coupler element 45 is accommodated in an expanded section 29 of the protective sleeve.

The protective sleeve 27, 29 prevents the opposing element 35 from being manipulated during every phase of the pivoting movement 25, but it also functions in this way both in the down position 20.1 of FIG. 3 and in the outwardly-pivoted position 20.2 of FIG. 8. In FIG. 8, the two engaged elements, namely, the element 35 and the opposing element 45, are located in the wide section 29 of the sleeve.

The narrow sleeve section 27 has a flattened area 28 on the side facing in the direction of the pivoting movement; this flattened area forms the previously mentioned stop which cooperates with the counterstop 48 on the housing. As FIG. 3 illustrates, this counterstop 48 is formed by a stepped profile 48, 49 in the housing wall 33. The counterstop 48 is at the same time the "tread" of this step. The "riser" 49 of the step, however, also has another function in the down position 20.1, namely, to act as a stop for the combination 20. For this purpose, it is preferable to use a buffer 14 of elastomeric material, which is anchored in a bore in the riser 49 and which cooperates with a suitable flattened area 54 of the cylinder housing 42.

As FIG. 4 illustrates, the cylinder axis 44 is set back toward the interior of the housing 32 from the pivot axis 15, which is perpendicular to it. The pivot axis 15, furthermore, is produced by two separate axle pins 12, 13, which consist here of cap screws. The two cap screws 12, 13 extend through housing bores 53 from the two opposite sides 61, 62 of the structural unit 11, passing through the bearing bushes 55, 56 mounted in the housing bores. The threaded parts of the two cap screws 12, 13 are anchored in threaded holes 57. There is a certain gap 58 between the ends of the two tightly screwed-in screws 12, 13. This gap 58 can be used to accommodate the lock cylinder 40. When the screws 12, 13 are made from steel rods, it is almost impossible to tear the cylinder out by force.

Figure 7:
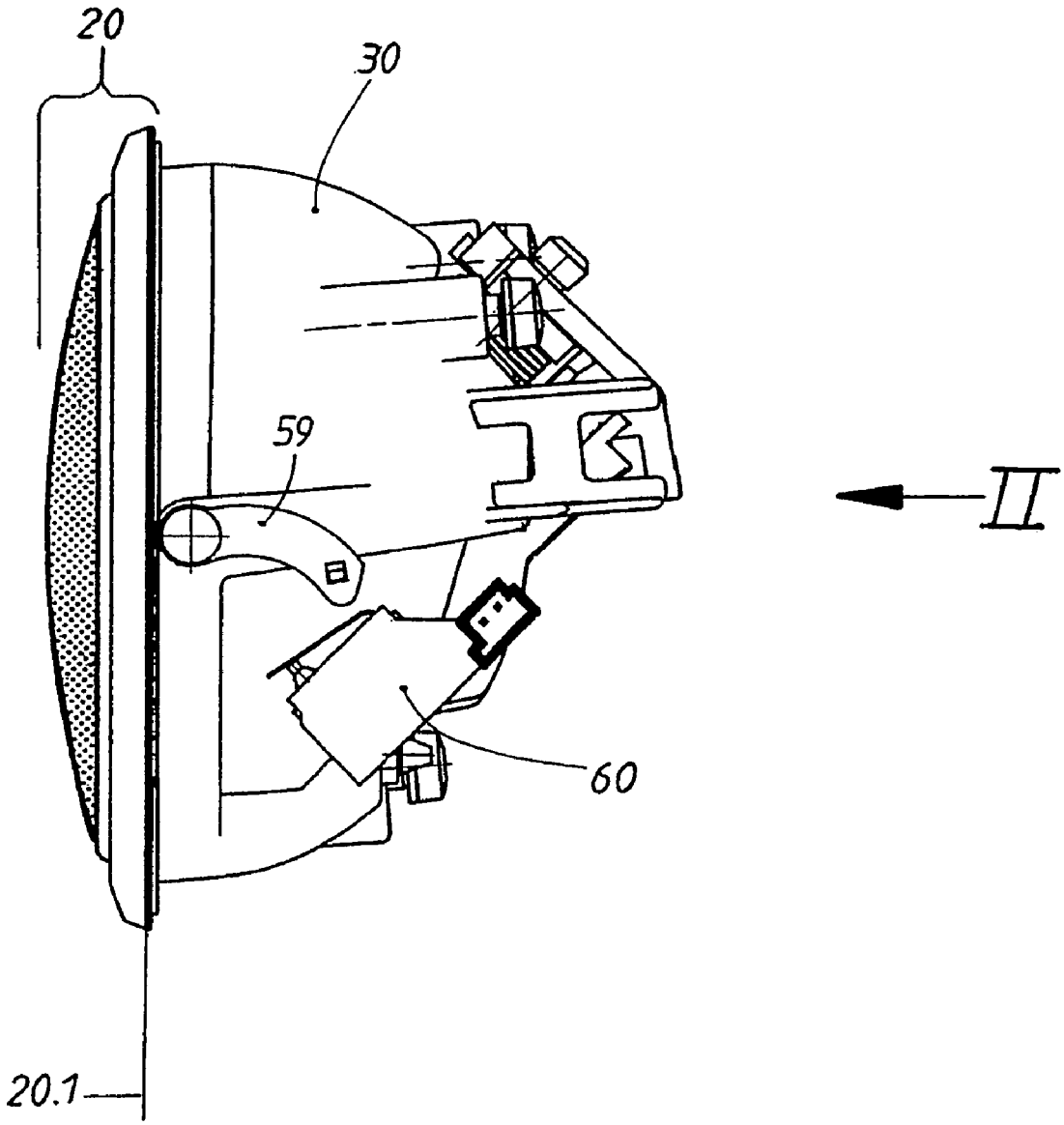
FIG. 7 shows a side view of the inventive lock assembly from the perspective of the arrow VII in FIG. 2.

As can be seen in the side view of FIG. 7, a working arm 59, which cooperates with a microswitch 60, is located on the outside surface of the housing 30.

As can be seen in FIG. 4, the arm 59 is made as an integral part of one of the bearing bushes 56. By tightening the cap screw 12, the combination 20 and the arm 59 are connected nonrotatably to each other.

Figure 5:
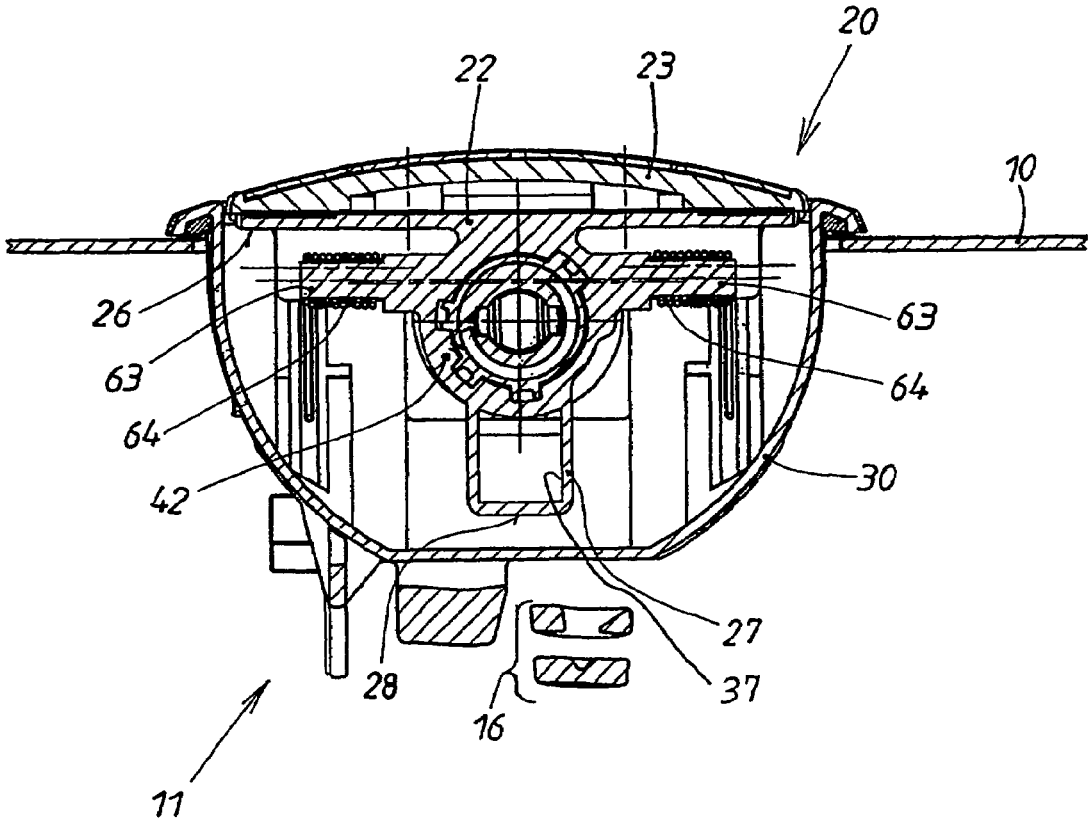

As can be derived from FIG. 5, pins 63, which are integral parts of the base plate 22, project from both sides of the cylinder housing 42; these pins accept two shank springs 64. The shank springs 64 are supported at one end against the housing and at the other end against the rear surface 26 of the combination 20. The elastic force which they provide ensures that the combination 20 is normally held in its down position 20.1 of FIG. 3.

LIST OF REFERENCE NUMBERS

10 body of the rear hatch, mobile part
11 structural unit consisting of 20 and 30
12 first axle pin, cap screw (FIG. 4)
13 second axle pin, cap screw (FIG. 4)
14 buffer on 49 (FIG. 3)
15 axis, pivot axis (FIG. 4)
16 driver
16.1 starting position of 16 (FIG. 6)
16.2 actuating position of 16 (FIG. 6)
17 hooking point for 51 on 14 (FIG. 6)
18 attachment of 52 to 30 (FIG. 6)
19 pivot angle
20 combination
20.1 down position of 20
20.2 outwardly-pivoted position of 20
21 handle of 20
22 base plate of 21
23 decorative plate of 20
24 company emblem on 23
25 arrow of the pivoting movement of 20
26 rear surface of 20
27 protective sleeve, narrow sleeve section
28 flattened area of 27, stop (FIG. 3)
29 protective sleeve, wide sleeve section
30 housing
31 opening of the housing
32 interior of the housing
33 housing wall
34 intermediate element
35 stationary opposing rotating coupler element
36 bearing neck of 35
37 coupling point of 35, flat profile piece (FIG. 3)
38 restoring spring 35 (FIG. 3)
39 means for fastening 30 to 11 (FIG. 2)
40 lock cylinder
41 key for 40
42 cylinder housing
43 output of 40
44 cylinder axis
45 movable rotating coupler element on 43
46 freewheel coupling between 40 and 45
47 coupling point of 45, interior space of fork (FIG. 3)
48 tread of the step of 30, counterstop
49 riser of the step of 30
50 link chain, Bowden cable
51 core of 50
52 sheath of 50
53 housing bore for 12, 13 (FIG. 4)
54 flattened area of 42 (FIG. 3)
55 first bearing bush for 13 (FIG. 4)
56 second bearing bush for 12 (FIG. 4)
57 threaded holes in 22 for 12, 13 (FIG. 4)

58 gap between 12 and 13
59 working arm (FIG. 4)
60 microswitch (FIG. 7)
61 first side of 11 for 12 (FIG. 4)
62 second side of 11 for 13 (FIG. 4)
63 pin for 64 (FIG. 5)
64 shank spring (FIG. 5)

The invention claimed is:

1. A lock assembly for a mobile part of a vehicle body such as a hatch or door, the lock assembly comprising a lock for securing the mobile part in a closed position with respect to a stationary part of the vehicle body;

a rotatable lock cylinder and a key for insertion in the lock cylinder, wherein, when turned in an emergency situation, the key rotates the lock cylinder and moves the lock between an unlocking position and a locking position;

a handle mounted on the mobile part, wherein the handle is operatively configured to pivot in a plane extending perpendicularly to the vehicle body;

the handle being movable between a closed position in which the handle is flush with the vehicle body and protects the lock cylinder and an outwardly-pivoted position in which the handle can be gripped manually for opening the mobile part;

the lock cylinder being accessible by the key when the lock cylinder is in the outwardly-pivoted position and the key can be actuated by rotation in the emergency situation for shifting the lock between the locking position and the unlocking position;

the lock cylinder being mounted on a rear surface of the handle so that the lock cylinder and the handle form a combination, the combination being a structural unit pivotably movable between the closed position and the outwardly-pivoted position;

the lock cylinder being arranged to point toward an interior of the mobile part when the combination is in the closed position;

a rotating coupler with a rotating coupler element configured to rotate along with the lock cylinder when the lock cylinder is rotated by the key, the rotating coupler element being mounted on the combination;

the rotating coupler having a stationary opposing element mounted at a defined location on the mobile part so as to act on the lock;

in the closed position of the combination, the stationary opposing element is uncoupled from the rotating coupler element, and, in the outwardly-pivoted position of the combination, the stationary opposing element is in rotating engagement with the rotating coupler element;

the stationary opposing element of the rotating coupler is arranged in a vertical plane in which the rotating coupler element moves during a coupling movement of the combination; and the rotating coupler element having a coupling point that engages during a last phase of the outward-pivoting movement of the combination with an opposing coupling point of the stationary opposing element.

2. The lock assembly according to claim 1, wherein the lock cylinder is integrated into material of the handle of the combination.

3. The lock cylinder according to claim 1, wherein the lock cylinder is mounted with an axis in a plane perendicular to the pivoting movement of the combination.

4. The lock assembly according to claim 1, wherein the lock cylinder has a cylinder housing that is an integral part of the handle of the combination.

5. The lock assembly according to claim 3, wherein the handle is comprised of at least one of a flat plate and an arched plate, and the axis of the lock cylinder extends essentially parallel to the plane of the plate.

6. The lock assembly according to claim 1, wherein the handle is comprised of a two-layer plate comprising a rear base plate provided with a bearing means for the pivoting movement of the combination and a decorative plate on a visible side of the handle.

7. The lock assembly according to claim 6, wherein the handle of the combination comprises a company emblem on the visible side.

8. The lock assembly according to claim 1, wherein a protective sleeve is mounted on a rear surface of the handle;

the protective sleeve surrounding the outside of the rotating coupling element and traveling with the rotating coupling element; and the protective sleeve accommodating at least a coupling point of the stationary opposing element during every phase of the pivoting movement and thereby protecting the lock against manipulating attempts.

9. The lock assembly according to claim 8, wherein the stationary opposing element simultaneously is a guide means for the protective sleeve during the pivoting movement of the combination.

10. The lock assembly according to claim 8, wherein the protective sleeve is an integral part of the handle of the combination.

11. The lock assembly according to claim 8, further comprising a housing, the handle being pivotable around an axis extending transversely through the housing;

the handle, when in the closed position, closed off an opening in the housing and forms together with the housing a structural unit, the structural unit being attachable as a whole to the mobile part of the vehicle body;

the stationary opposing element being rotatably supported at a defined point in a wall of the housing, wherein the opposing coupling point of the stationary opposing element points into an interior of the housing and toward the combination;

a driver connected nonrotatably on an outside surface of the housing to the stationary opposing element, wherein the driver is connected to the lock by an link chain.

12. The lock assembly according to claim 11, further comprising a movable stop on the handle and a stationary counterstop on the housing;

the movable stop, when in the outwardly-pivoted position, makes contact with the stationary opposing counterstop and thereby limits an outward pivot angle of the combination;

the movable stop being formed by a section of the protective sleeve facing into a direction of the pivoting movement.

13. The lock assembly according to claim 11, the housing wall having a step facing the interior of the housing;

the step having a tread facing the stationary opposing element, the step serving as a counterstop and cooperating with the protective sleeve, and limiting the outwardly pivoted position of the combination.

14. The lock assembly according to claim 13, wherein a stop for the closed position of the combination is formed by a riser of the step in the housing, wherein a surface of the riser faces a housing opening.

15. The lock assembly according to claim 14, wherein the riser comprises an elastic buffer.

16. The lock assembly according to claim 11, wherein the pivot axis of the combination comprises two separate axle pins, the axle pins being introduced from opposite outside surfaces so as to pass through two bores in the housing and extend into two blind holes in the combination.

17. The lock assembly according to claim 16, wherein, in an installed condition of the axle pins a gap exists between facing ends of the pins, the lock cylinder being arranged in the gap.

18. The lock assembly according to claim 16, wherein a cylinder axis of the lock cylinder extends perpendicularly to the pivot axis and is set back into the interior of the housing from the pivot axis.

19. The lock assembly according to claim 16, wherein the axle pins are comprised of two cap screws extending through two bearing bushes mounted in the two bores in the housing and anchored in two threaded holes in the combination.

20. The lock assembly according to claim 19, further comprising a working arm mounted on an outside surface of the housing, the working arm being connected nonrotatably to the combination and pivoting with the combination during pivoting movement of the combination.

21. The lock assembly according to claim 20, wherein the nonrotatable connection between the working arm and the combination is effected by one of the screws forming the pivot axis.

22. The lock assembly according to claim 20, wherein the working arm is seated nonrotatably in one of the bearing bushes so as to form an arm-bush unit, and the arm-bush unit is anchored in the combination by a screw which extends through the bearing bush.

23. The lock assembly according to claim 1, comprising a freewheel coupling between the lock cylinder and the rotating coupler element, wherein the freewheel coupling is mounted so as to move concomitantly with the combination, wherein the freewheel coupling disconnects the nonrotatable connection between the lock cylinder and the rotating coupler element when the lock cylinder is turned by force.

* * * * *